United States Patent [19]

Rognon

[11] Patent Number: 4,674,278

[45] Date of Patent: Jun. 23, 1987

[54] SAFETY EXHAUST SYSTEM WITH SWITCHING FOR AN INTERNAL COMBUSTION ENGINE

[76] Inventor: Armand Rognon, Verneuil Sous Coucy, 02380 Coucy Le Chateau Auffrique (Aisne), France

[21] Appl. No.: 868,082

[22] Filed: May 29, 1986

[30] Foreign Application Priority Data

Jun. 6, 1985 [FR] France ..... 85 08543

[51] Int. Cl.[4] ..... F01N 3/02

[52] U.S. Cl. ..... 60/295; 55/284; 55/314; 55/DIG. 30

[58] Field of Search ..... 60/295, 296; 55/284, 55/314, 422, 484, DIG. 30

[56] References Cited

U.S. PATENT DOCUMENTS 3,445,196 5/1969 Thomas ..... 60/295

4,281,512 8/1981 Mills .

4,485,622 12/1984 Takagi ..... 55/DIG. 30

FOREIGN PATENT DOCUMENTS 3204176 8/1983 Fed. Rep. of Germany ..... 60/296

1456066 9/1965 France .

2494769 5/1982 France .

2068258 8/1981 United Kingdom .

*Primary Examiner*—Douglas Hart

*Attorney, Agent, or Firm*—Stevens, Davis, Miller & Mosher

[57] ABSTRACT

A safety exhaust system is provided for an internal combustion engine comprising a device for switching the combustion gases of an internal combustion engine towards one or other of two cases, said device being controlled by a shaft integral with locking means controlled by the positioning of a flame trap assembly on this case.

8 Claims, 3 Drawing Figures

SAFETY EXHAUST SYSTEM WITH SWITCHING FOR AN INTERNAL COMBUSTION ENGINE

BACKGROUND OF THE INVENTION

1. Field of the Invention

The present invention relates to a safety exhaust system for an internal combustion engine, comprising a case receiving a flame trap stack and means for mounting this stack in this case.

Such a system is used in an explosive environment such for example as in the vicinity of oil drilling wells.

2. Description of the Prior Art

Such a system is already known, in which the stack, formed by bored washers of appropriate thickness and spacing, serves for externally discharging and laminating the combustion gases of the internal combustion engine so as to extinguish the incandescent carbon particles which they contain. This stack finishes then by becoming clogged up and must be replaced before such clogging up prevents the normal discharge of the combustion gases.

In this known system, the replacement of the choked up stack by a clean stack means that the engine must be stopped at least during the time required for removing the choked up stack and refitting the clean stack.

Now this requirement to stop the engine is a drawback, in particular on oil drilling platforms where it is particularly costly.

The present invention overcomes this drawback.

SUMMARY OF THE INVENTION

For this, the present invention provides a safety exhaust system for an internal combustion engine of the above described type, comprising another case receiving another flame tap stack, other means for mounting this other stack in this other case, a device for diverting the gases of the engine to one or other of the two cases, and means for controlling the switching device adapted for cooperating with the mounting means and for preventing the gases being diverted towards a case whose stack is incorrectly fitted.

With the system of the invention, when the stack of the case towards which the combustion gases are diverted is choked up, control of the diversion of these gases towards the other caseis only possible if this case is itself correctly equipped with a stack. The control of the switching and replacement of the choked up stack are therefore carried out without stopping the engine and with every safety, that is to say without any risk of placing the combustion gases in direct communication with the combustive atmosphere.

In the preferred embodiment, the control means comprise locking means on each of the cases, controlled by the respective means for mounting the stacks.

Advantageously, the control means comprise locking means on the mounting means.

Again advantageously, the locking means on the mounting means are adapted for locking the mounting means on their respective cases.

BRIEF DESCRIPTION OF THE DRAWINGS

The invention will be better understood from the following description of the preferred embodiment of a system of the inventon, with reference to the accompanying drawings in which.

DESCRIPTION OF THE PREFERRED EMBODIMENTS

The explosion proof exhaust system which will be described is connected to the exhaust outlet of the combustion gases of an internal combustion engine, not shown.

Figure 1:
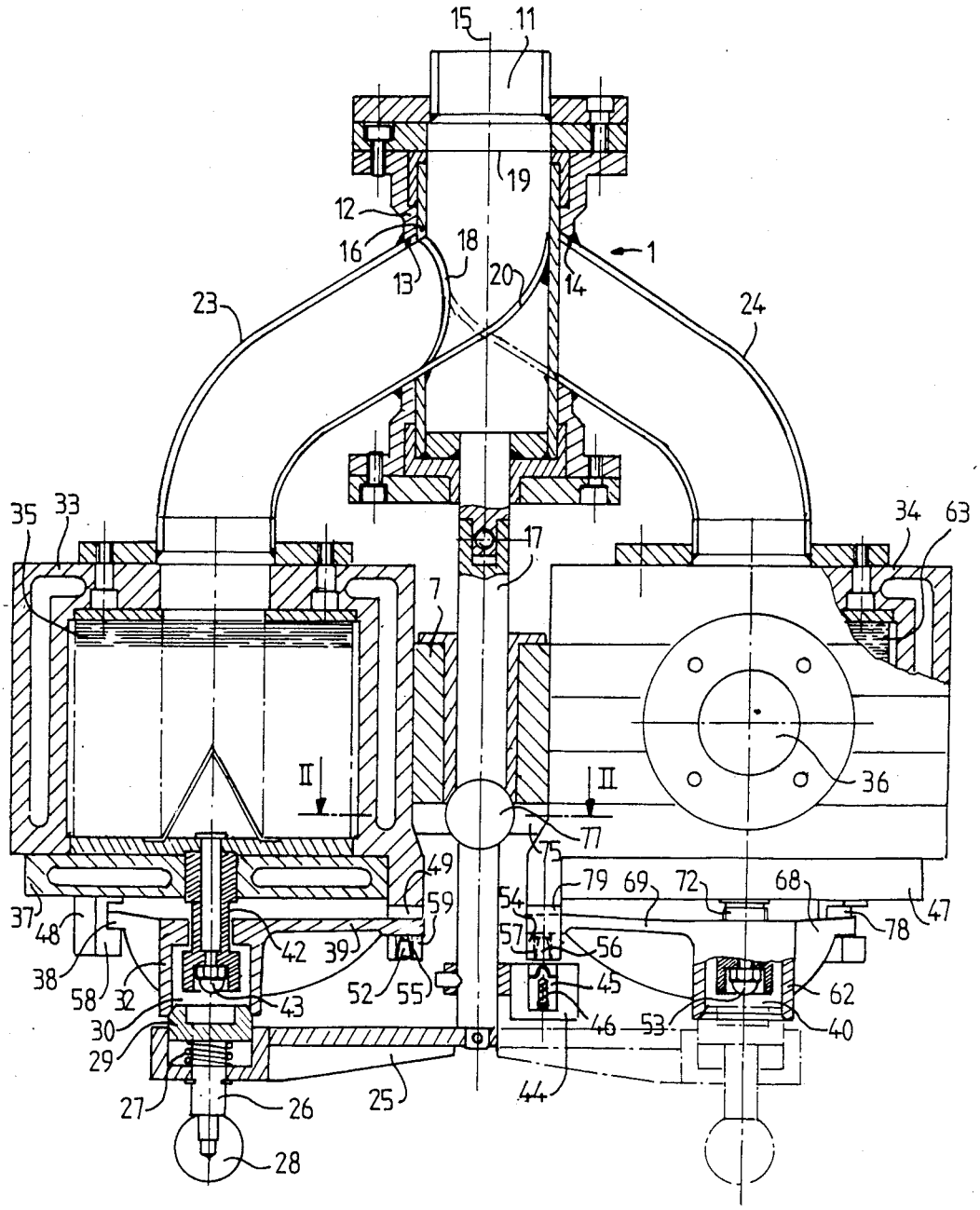
FIG. 1 shows partial sectional view of the system of the invention.

Referring to FIG. 1, this system comprises a device 1 for switching or diverting the combustion gases, whose input 11 is connected to the engine.

The switching device 1 comprises, in the extension of inlet 11, a hollow cylindrical body of revolution 12 having side openings 13 and 14 symmetrical with respect to the axis 15 of body 12. A sleeve 16 is a tight fit inside body 12, where it may rotate on itself under the action of a shaft 17, to which it is secured and which extends along the axis 15. Sleeve 16 is open at its axial end 19 facing inlet 11, and it comprises a single side opening 18. A wall 20 closes off the end of sleeve 16 opposite the end 19 so as to form, for the gases, a guide without discontinuity from the axial opening 19 as far as the side opening 18.

The side opening 18 is shaped and arranged so that it may coincide exactly with the opening 13 in body 12, as is shown with continuous lines in FIG. 1, or, after rotation through 180° of shaft 17, with opening 14 as is shown with broken lines in FIG. 1.

Two symmetrical ducts 23 and 24 connect each opening 13 and 14 to two cases 33 and 34 respectively. Cases 33 and 34, which are identical, are disposed symmetrically with respect to a sleeve 7 to which they are fixed and in which the shaft 17 may rotate.

Case 13 is provided, in a conventional way, with a flame trap stack 35, formed of bored washers of appropriate thickness and spacing.

The stack 35 is disposed so as to be in the path of the combustion gases inside case 33, between duct 23 and an outlet with which case 33 is provided, which outlet is not shown in the Figure but is identical to the outlet 36 with which case 34 is provided.

Stack 35 is fixed to a metal cover 37 which closes an opening formed in a wall of case 33, perpendicular to the axis 15, so as to allow replacement of stack 35 when it is clogged up.

Cover 37 and stack 35 are held in position by a yoke 32 having three arms, only two of which 38 and 39 are shown in FIG. 1. Each of these arms 38 and 39, like the arm which is not visible, is adapted for cooperating in a conventional way with respectively three projections on case 33, only two of which 48 and 49 are shown in FIG. 1. These three projections are provided with lugs perpendicular to axis 15, such as 58 and 59, on which the arms 38, 39 and the arm which is not visible come to bear. The yoke 32 and the cover 37 are joined together by a clamping socket 42, the clamping or unclamping of which, causes yoke 32 and cover 37 to draw together or move away from each other. A lock nut 43, whose pitch is reversed, provides counterlocking of socket 42.

As shown in FIG. 1, lug 59, which is the closest to shaft 17, comprises a hole or housing 55 parallel to axis 15, inside which a cylindrical peg 52 whose height is equal to that of lug 59 is mounted freely movable in translation between two endmost positions, determined for example by a stop not shown. In one of the endmost positions, peg 52 is entirely housed in the hole 55 in lug 59. In the other endmost position, peg 52 projects from lug 59, towards the top of the Figure, under the action of locking means which will be discussed hereafter; this position is only reached by the peg when arm 39 is not bearing on lug 59.

Case 34 is arranged like case 33. It is thus provided with a stack 63 fixed to a cover 47 held in position by a yoke 62 whose arms such as 68 and 69 cooperate with-projections 78 and 79 on the case 34 under the action of a socket 72 and a lock nut 53. Projection 79, the closest to shaft 17, comprises, like projection 49, a horizontal lug 54, having a housing 57 and a peg 56.

The lowerpart, in FIG. 1, of shaft 17 is integral with an arm 25, which is perpendicular thereto and supports a rod 26, parallel to axis 15, having at one end a handle 28 and at the other end a locking tooth 29, movable in axial translation and urged upwardly, in FIG. 1, by the force exerted by the compression spring 27.

The whole is arranged so that, in the position shown in FIG. 1, where opening 13 in body 12 of the switching device 1 coincides with the opening 18, tooth 29 closes a cavity 30 containing the lock nut 43 so as to forbid access thereto.

The lower part, in FIG. 1, of shaft 17 is also integral with a locking plate 44 comprising a locking stud 45 movable in translation in a housing, in a direction parallel to that of axis 15, and urged by the force, directed towards yoke 62, exerted by compression spring 46.

A hole is arranged so that, in the position shown in FIG. 1, plate 44 comes flush with the lower part, in FIG. 1, of lug 54, stud 45 being pushed back against its spring 56 into its housing because of peg 56 which prevents it from penetrating into the housing 57 of lug 54.

Figure 2:
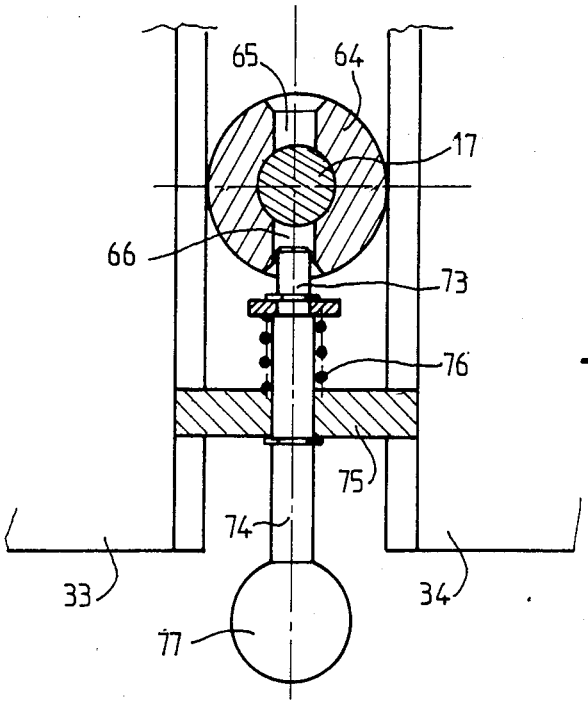
FIG. 2 shows a view, in section through plane II—II of a detail of the system of FIG. 1.

Referring to FIG. 2, shaft 17 is integral with a sleeve 64, having two cylindrical holes 65 and 66 perpendicular to the axis 15 and symmetrical with respect thereto. A rod 74, having at one end a handle 77, and movable in translation perpendicularly to axis 15, on a support 75 integral with the cases 33 and 34 and sleeve 7, is urged by the force exerted by a compression spring 76. The arrangement is such that, in the position shown in FIG. 1, the end 73 of rod 74, opposite handle 77 is engaged in the cylindrical hole 66.

The system which has just been described operates in the following way.

Before use, handle 77 being pulled so as to release sleeve 64 and shaft 17, arm 25 is placed in any position giving access to the lock nut 43 of yoke 32. Then a clean stack 35 is fitted in case 33, the assembly formed by cover 37 and yoke 32 is engaged and, so as to hold it in position, after engaging each of the arms such as 38 and 39 in each of the corresponding projections such as 48 and 49, by causing yoke 32 to pivot slightly, socket 42 is clamped and is locked by the lock nut 43. The yoke 32 moves away from cover 37 until, with the arms such as 38 and 39 bearing firmly on lugs such as 58 and 59, the cover 37 hermetically closes case 33.

Subsequently, the procedure will be strictly the same for providing case 34 with a clean stack and for holding it in position by means of cover 47 and yoke 62. Then, with the handle 28 pulled downwardly, in FIG. 1, arm 25 is placed in the position shown in FIG. 1, where it is locked by the engagement of tooth 29 in the cavity 30 when the handle 28 is released, which also results in forbidding access to the lock nut 43, and so locking it to the case 33. Simultaneously the end 73 of rod 74 is engaged in the cylindrical hole 66.

The system may then be used normally. The incoming combustion gases at inlet 11 are switched by the switching device 1 towards case 33, where they must pass through stack 35 before being discharged into the free air through the outlet of case 33.

When, after a certain time of use, stack 35 becomes clogged up and must be changed, shaft 17 is released by pulling handle 77 and handle 28. Handle 28 is moved so that shaft 17 rotates through 180° . Tooth 29 is engaged in the corresponding cavity 40 of yoke 62, as is shown with a broken line in the Figure, and simultaneously the end 73 of rod 74 is engaged in the cylindrical hole 65. Opening 18 now coincides with opening 14 and it is case 34, provided with its clean stack, which is in use. Plate 44 is opposite lug 59.

Then the choked up stack 35 may be changed by unscrewing the lock nut 43 for releasing the assembly formed by cover 37 and yoke 32.

Rotation of arm 25 has driven plate 44 under lug 59 and yoke 45 under peg 52. As long as the arm 39 is not bearing against lug 59, peg 52 cannot be released from its housing 55. As soon as the yoke 32 is removed, and with it consequently arm 39, stud 45, under the action of its spring, may push peg 52 out of its housing and come in its turn into engagement in the housing of peg 52 for locking the plate 44 to the case 33.

In this situation, it is impossible, even by pulling handle 77 and 28 simultaneously, to free the lever 17 integral with the immobilized plate 44.

The fitting of a clean stack, or refitting of a cleaned stack 35, releases or unlocks plate 44, for arm 39 of yoke 32 pushes peg 52 back in the other direction into its housing this latter in its turn pushing stud 45 out of the housing of peg 52.

When the stack of case 34 is choked up, the combustion gases may then be switched towards case 33, and so on.

The system of the invention allows then a choked up stack to be replaced and even cleaned without stopping the engine, and with every safety because of the combination of the following characteristics:

- impossibility of access to the lock nut 43, that is to say locking of this lock nut 43 and of socket 42 and so impossibility of removing the stack 35 in service because of the engagement of tooth 29 of rod 26 in the cavity 30 of yoke 32;
- impossibility of causing switching towards case 34 if this case is not fitted with a stack 63, because of the engagement of stud 45 in the hole 57 which serves a housing for peg 56;
- impossibility of leaving the switching device too long in the intermediate position because of the inevitable choking of the internal combustion engine if opening 18 is closed, even partially, for too long a time,
- need to operate handle 77 at the same time as handle 28 for any control of the switching.

Thus, with the system of the invention, it is impossible, even after a false manoeuver, to place the combustion gases in direct communication with the ambient atmosphere, without passing through a flame trap stack.

Naturally, the scope of the present application is not limited to the description which has just been made, of the preferred embodiment of the system of the invention.

In particular, the locking tooth 29 may cooperate with a cavity, situated, for example, in each of the yokes 32 and 62 for locking the switching device in each of the two operating positions, without access to the lock nuts 43 or 53 being prevented. Similarly, the device comprising cylinder 64, rod 74 and handle 77 may be omitted without departing from the scope of the invention.

The switching device 1 of FIG. 1 controlled by the rotation of shaft 17 may be dapted to all other directional applications in the case of a machine discharging or sucking in a fluid, for example gas or even air.

Figure 3:
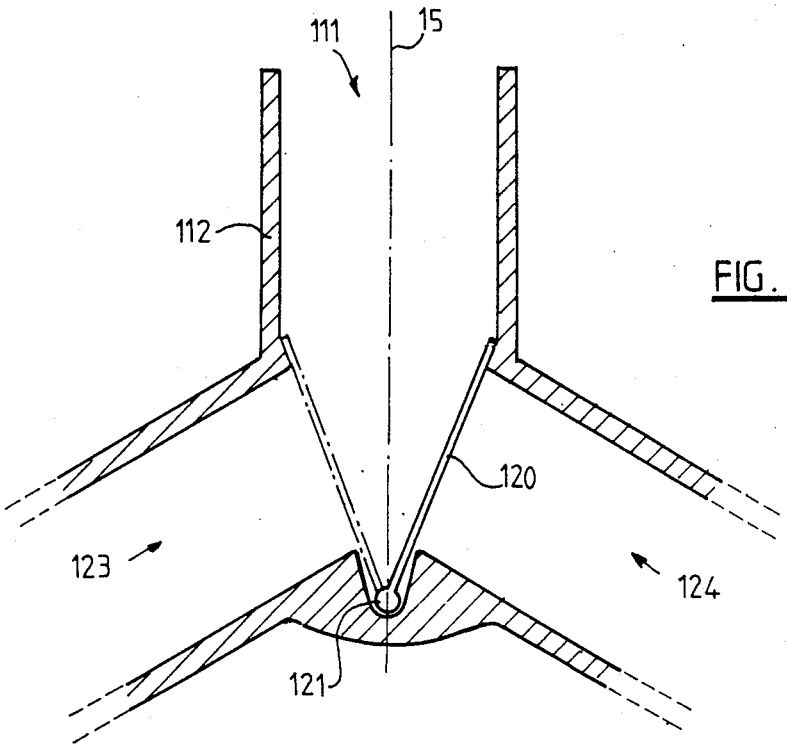
FIG. 3 shows a view of a variant of construction of the switching device of the system of FIG. 1

Finally, this switching device 1 may be of any other type, and in particular of the type shown in FIG. 3 where the gases arriving through an inlet 111 are switched to an output 123 or an output 124 of a body 112 by means of a valve 120 pivotably mounted along axis 121 perpendicular to axis 15 and to the plane of the Figure, valve 120 closing the outlet 124, as is shown in continuous lines in FIG. 3, or outlet 123, as is shown with broken lines. Control of valve 120 from pivoting of lever 17 is then provided by means of a linkage which is not shown because it is known.

What is claimed is

1. A safety exhaust system for an internal combustion engine, comprising a case receiving a flame trap stack, and means for mounting this stack in this case, further comprising another case receiving another flame trap stack, other means for mounting this other stack in this other case, a device for switching the gases from the engine towards one or the other of the two cases, and means for controlling the switching device adapted for cooperating with the mounting means and preventing switching of the gases towards a case whose stack is incorrectly fitted.

2. The exhaust system as claimed in claim 1, wherein said control means comprise locking means on each of the cases controlled by the respective mounting means of the stacks.

3. The exhaust system as claimed in one of claims 1 or 2, wherein said control means comprise locking means on the mounting means.

4. The exhaust system as claimed in claim 3, wherein said locking means on said mounting means are adpted for locking the mounting means on their respective cases.

5. The system as claimed in claim 2, wherein the control means of the switching device comprise a shaft integral with a locking plate, the locking means on each of the cases further comprise a stud movable under the action of a spring, mounted on said plate, and the mounting means push said stud out of a housing of the corresponding case.

6. The system as claimed in claim 5, wherein the mounting means of each case comprise a yoke having at least one arm coming to bear on at least one projection of each case, having a peg pushed back by said arm, said peg pushing the stud out of the housing.

7. The system as claimed in one of claims 5 or 6, wherein said control means comprise an arm having two positions corresponding to the switching of the gases towards one or other case, the locking means on said mounting means comprise a locking tooth mounted on the arm, the mounting means of each case comprise a lock nut contained in a cavity closed by said tooth.

8. The system as claimed in claim 4, wherein said control means comprise an arm having two positions corresponding to the switching of the gases towards one or other case, the locking means on said mounting means comprise a locking tooth mounted on the arm, the mounting means of each case comprise a lock nut contained in a cavity closed by said tooth.

* * * * *